US007541989B2

(12) United States Patent
Shih

(10) Patent No.: US 7,541,989 B2
(45) Date of Patent: Jun. 2, 2009

(54) WIRELESS COMMUNICATION DEVICE AND ANTENNA THEREOF

(75) Inventor: Yen-Yi Shih, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 10 days.

(21) Appl. No.: 11/615,009

(22) Filed: Dec. 22, 2006

(65) Prior Publication Data

US 2007/0296637 A1 Dec. 27, 2007

(30) Foreign Application Priority Data

Jun. 23, 2006 (TW) ..... 95122727 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 793, 797, 810–820, 846
See application file for complete search history.

(56) References Cited

U.S. PATENT DOCUMENTS 5,930,694 A 7/1999 Shima
6,867,746 B2 * 3/2005 Mendolia et al. ..... 343/841
6,922,471 B1 7/2005 Marqvardsen et al.
6,958,732 B2 * 10/2005 Yuanzhu ..... 343/702
2002/0022459 A1 * 2/2002 Kobayashi ..... 455/90
2003/0201948 A1 * 10/2003 Phelan et al. ..... 343/895
2005/0003849 A1 1/2005 Ramian
2005/0233781 A1 10/2005 Erixon et al.

FOREIGN PATENT DOCUMENTS

JP 4290345 10/1992
JP 2002044199 2/2002

* cited by examiner

*Primary Examiner*—Shih-Chao Chen
(74) *Attorney, Agent, or Firm*—Wei Te Chung

(57) ABSTRACT

A wireless communication device (10) includes an antenna (12), an electronic element (14), and a support member (18). The antenna for radiating and receiving electromagnetic signals is disposed on one side of the electronic element. The support member includes at least one support portion disposed between the antenna and the electronic element to form a space for spacing the antenna and the electronic element to enhance the radiation efficiency of the antenna.

15 Claims, 9 Drawing Sheets

WIRELESS COMMUNICATION DEVICE AND ANTENNA THEREOF

BACKGROUND OF THE INVENTION

1. Field of the Invention

The present invention relates to electronic devices, i.e., wireless communication devices, and particularly to an electronic device having an antenna for wireless communication.

2. Description of Related Art

In a wireless communication device, an antenna is a key element for radiating and receiving radio frequency signals. Characteristics of the antenna, such as radiation efficiency, have a significant influence on performance of the wireless communication device.

Referring to FIG. 8, it is a schematic diagram of a conventional wireless communication device 20. The wireless communication device 20 includes an antenna 22, a surface acoustic module (SAM) 24, and a circuit board 26. One surface of the SAM 24 is directly contacted with the circuit board 26, and the other surface of the SAM 24 is directly contacted with the antenna 22. The antenna 22 is fixed on the SAM 24 by hot melting. However, radiation efficiency of the antenna 22 of the conventional wireless communication device 20 is reduced because parts of the common-used lossy SAM 24, which are nearest to antenna 22 and circuit board 26 could result in higher dielectric loss.

Therefore, a heretofore unaddressed need exists in the industry to overcome the aforementioned deficiencies and inadequacies.

SUMMARY OF THE INVENTION

In one aspect of the invention, a wireless communication device includes an antenna, an electronic element, and a support member. The antenna for radiating and receiving electromagnetic signals is disposed on one side of the electronic element. The support member includes at least one support portion disposed between the antenna and the electronic element to form a space for spacing the antenna and the electronic element.

In another aspect of the invention, a wireless communication device includes a circuit board, an electronic element, an antenna, and at least one support portion. The antenna is for radiating and receiving electromagnetic signals. The electronic element is sandwiched between the circuit board and the antenna. The at least one support portion is disposed between the antenna and the electronic element for spacing the antenna and the electronic element.

Other advantages and novel features will become more apparent from the following detailed description when taken in conjunction with the accompanying drawings, in which:

DETAILED DESCRIPTION OF THE INVENTION

Figure 1:
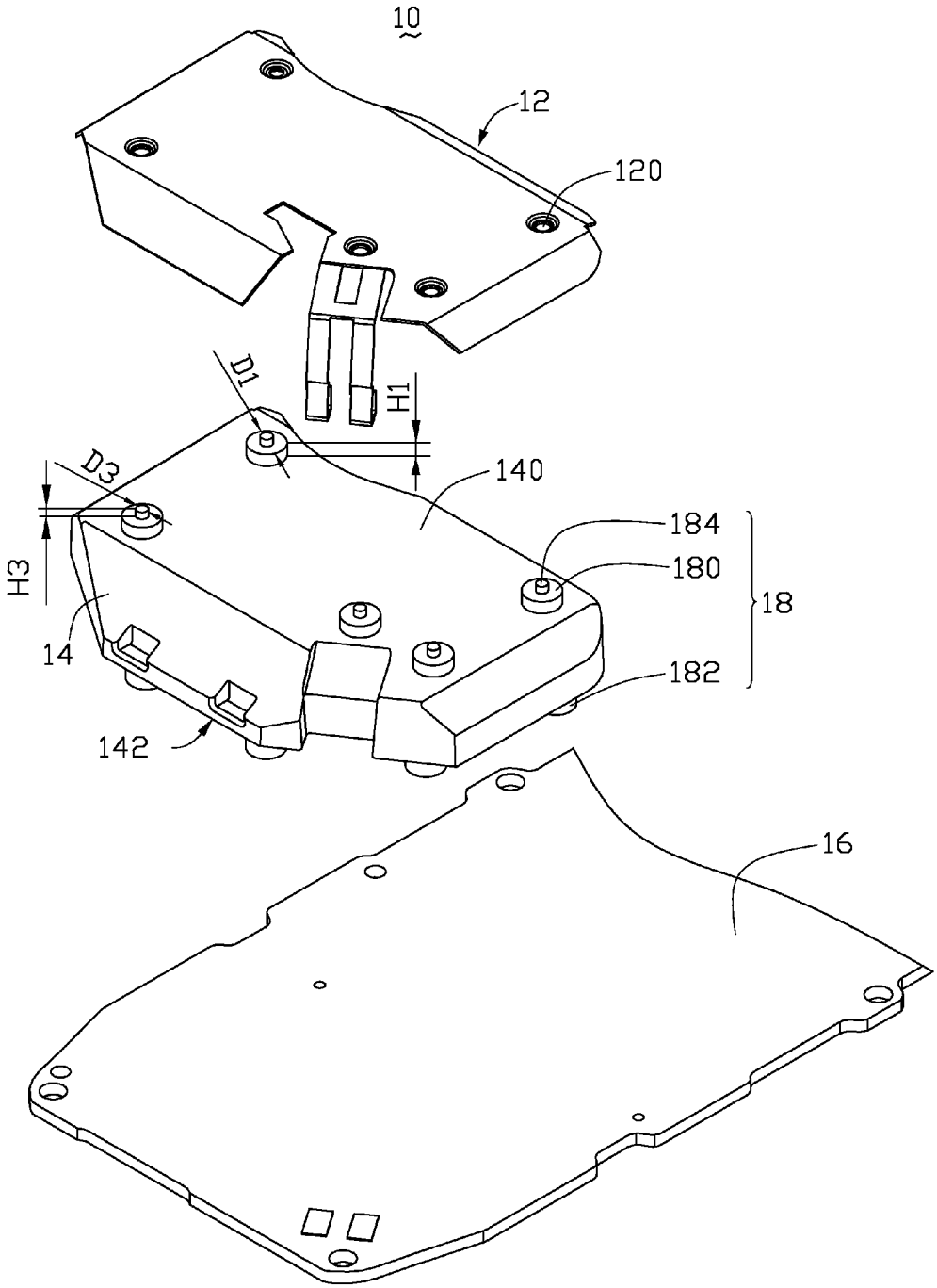
FIG. 1 is an exploded, schematic view of a wireless communication device of an exemplary embodiment of the present invention.

FIG. 1 is an exploded, schematic view of a wireless communication device 10 of an exemplary embodiment of the present invention. The wireless communication device 10 includes an antenna 12, an electronic element 14, a circuit board 16, and support members 18, wherein the electronic element 14 is disposed between the circuit board 16 and the antenna 12. The antenna 12 is provided for radiating and receiving electromagnetic signals, and is disposed beside one side of the electronic element 14. The antenna 12 defines an extending plane (not labeled) along the one side of the electronic element 14 and a plurality of bending flanges around the plane. The circuit board 16 is disposed beside an opposite side of the electronic element 14. In the exemplary embodiment, the electronic element 14 is an acoustic module, preferably a surface acoustic module (SAM). The support members 18 extend from two opposite surfaces 140, 142 of the SAM 14.

Each support member 18 includes a first support portion 180, a second support portion 182, and a fixing portion 184. The first support portion 180 extends from a first surface 140 of the SAM 14, and into a space 20 (shown on FIG. 2) formed between the antenna 12 and the SAM 14, for spacing the antenna 12 and the electronic element 14. The second support portion 182 extends from a second surface 142 of the SAM 14, and into a space 22 (shown on FIG. 2) formed between the SAM 14 and the circuit board 16, for spacing the SAM 14 and the circuit board 16. In the exemplary embodiment, the first surface 140 is opposite to the second surface 142. The first support portion 180 between the antenna 12 and the SAM 14 and the second support portion 182 between the SAM 14 and the circuit board 16 are insulative.

The fixing portions 184 extend from the first support portions 180 for fixing the antenna 12 on the first support portions 180 of the support members 18. In the exemplary embodiment, the first support portions 180, the second support portions 182, the fixing portions 184, and the SAM 14 are integrally formed. In the exemplary embodiment, the first support portions 180, the second support portions 182, and the fixing portions 184 are plastic cylinders. Quantities, diameters D1, and heights H1 of the first support portions 180 are substantially the same as those of the second support portions 182. There are as many fixing portions 184 as there are first support portions 180. In alternative exemplary embodiments, the quantities of the first support portion 180, the second support portion 182, and the fixing portion 184 may differ from each other. In the exemplary embodiment, diameters D3 of the fixing portions 184 are less than the diameters D1 of the first support portions 180, and heights H3 of the fixing portions 184 are less than the heights H1 of the first support portions 180.

The antenna 12 includes a plurality of holes 120 corresponding to the fixing portions 184. In the exemplary embodiment, diameters (not labeled) of the holes 120 are bigger than the diameters D3 of the fixing portions 184, and are less than the diameters D1 of first support portions 180.

Figure 2A:
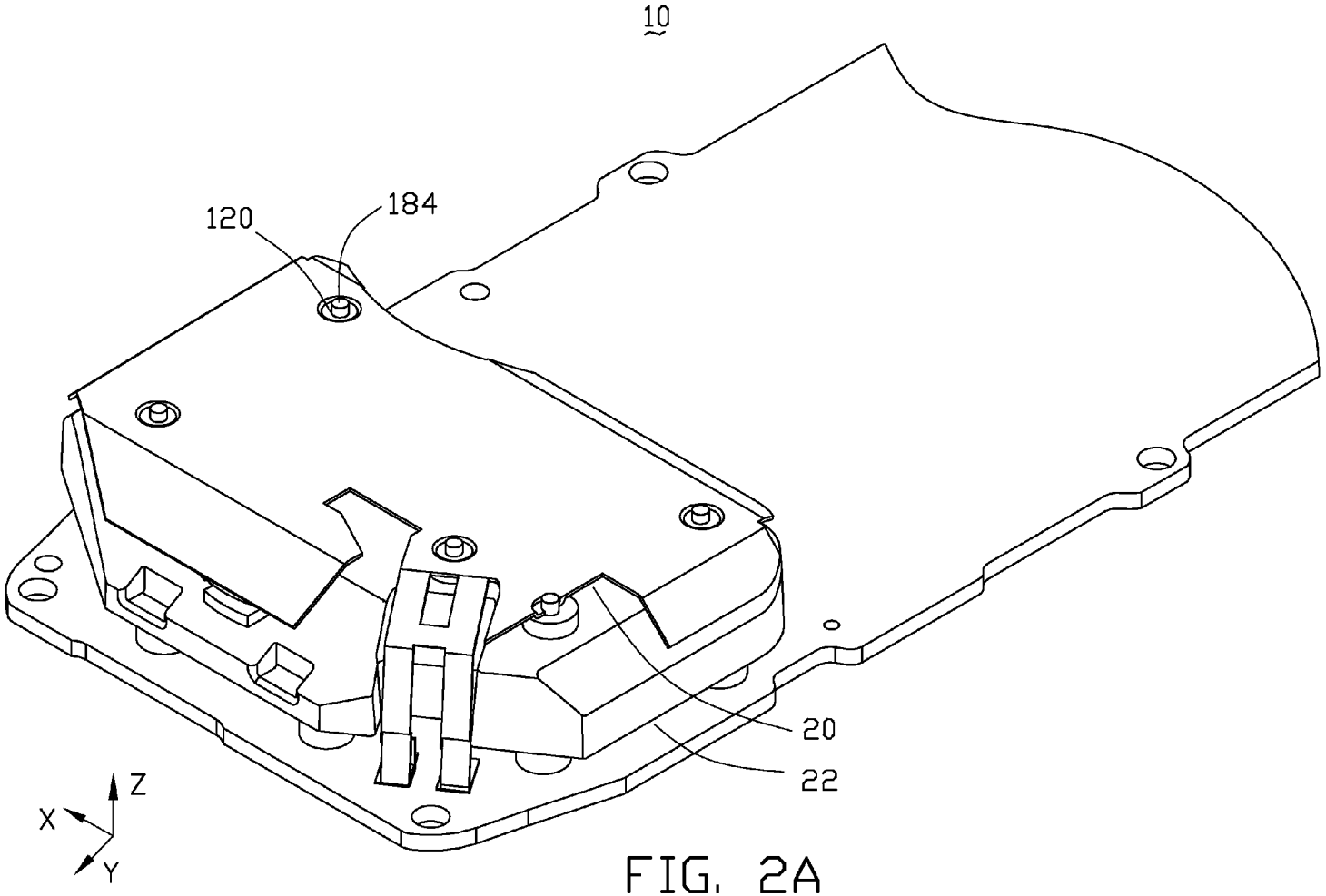
FIG. 2A is an assembled view of FIG. 1.
Figure 2B:
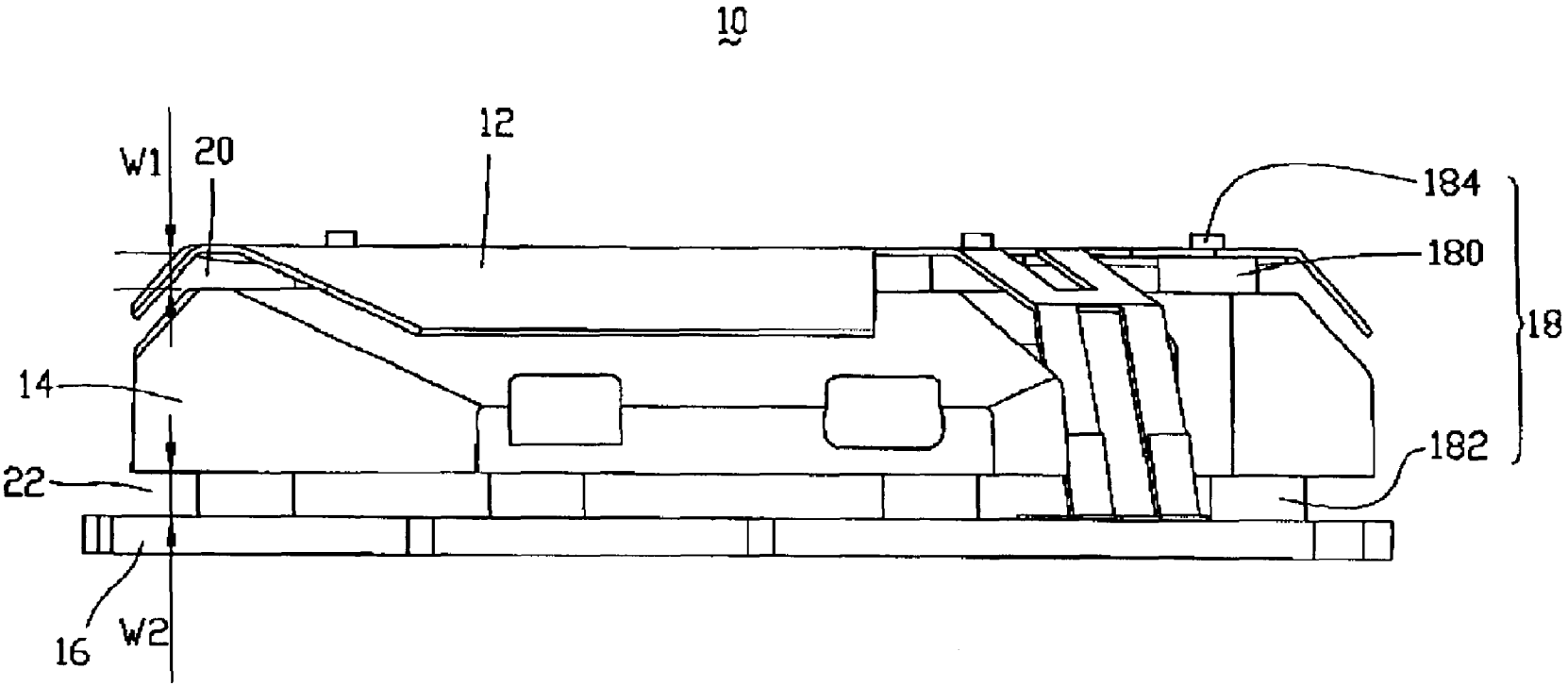
FIG. 2B is a side view of FIG. 2A from a Y-axial negative direction.

FIG. 2A is an assembled view of FIG. 1. FIG. 2B is a side view of FIG. 2A from Y-axial negative direction. In assembly, the fixing portions 184 of the support members 18 are inserted into the holes 120 of the antenna 12, and the antenna 12 is fixed on the first support portions 180 of the SAM 14 by hot melting the fixing portions 184. The second support portions 182 of the SAM 14 are disposed on the circuit board 16. The space 20 is formed between the antenna 12 and the SAM 14 because of the first support portions 180, and the space 22 is formed between the SAM 14 and the circuit board 16 because of the second support portions 182.

In the exemplary embodiment, a height W1 of the space 20 and a height W2 of the space 22 are 1 millimeter (mm). In other exemplary embodiments, the height W1 of the space 20 and the height W2 of the space 22 can be between 0.1~2.0 mm.

In alternative exemplary embodiments, shapes of the first support portions 180, the second support portions 182, the fixing portions 184, and the holes 120 can be other than cylindrical.

Figure 3:
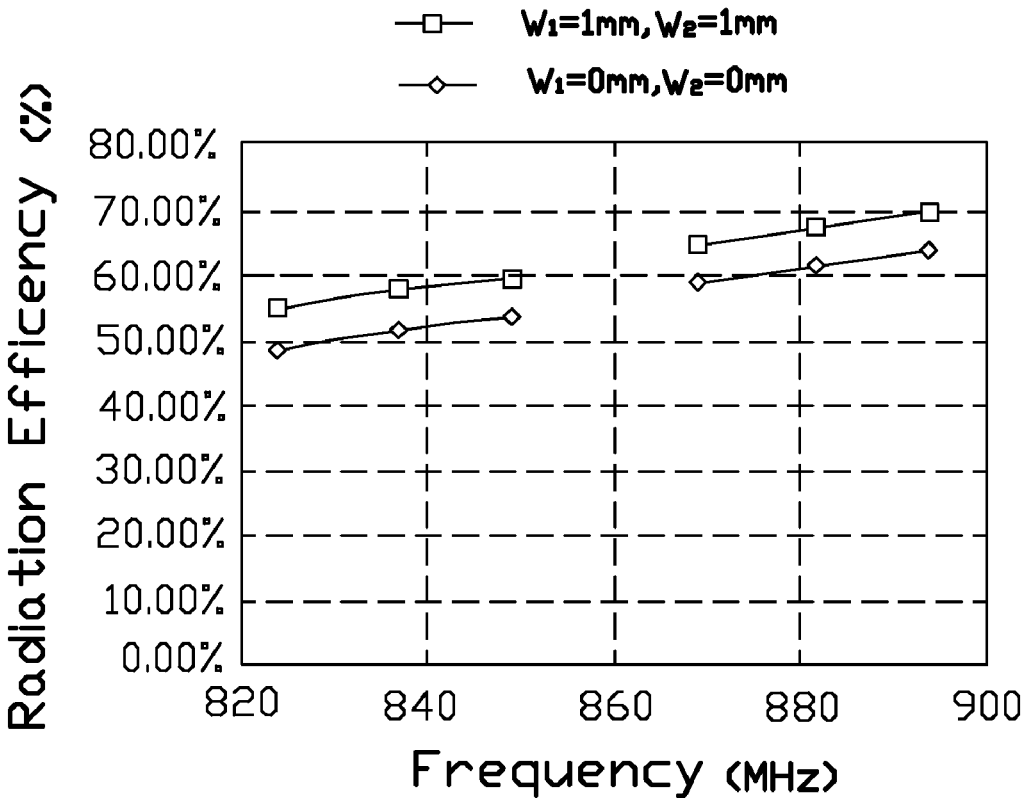
FIG. 3 is a graph of simulated test results showing radiation efficiency of an antenna of the wireless communication device of FIG. 1.

FIG. 3 is a graph of simulated test results showing radiation efficiency of the antenna 12 of the wireless communication device 10 of FIG. 1. As shown, the radiation efficiency of the antenna 12 with the heights W1, W2 at 1 mm is better than the radiation efficiency of the antenna 12 with the heights W1, W2 at 0 mm.

Figure 4:
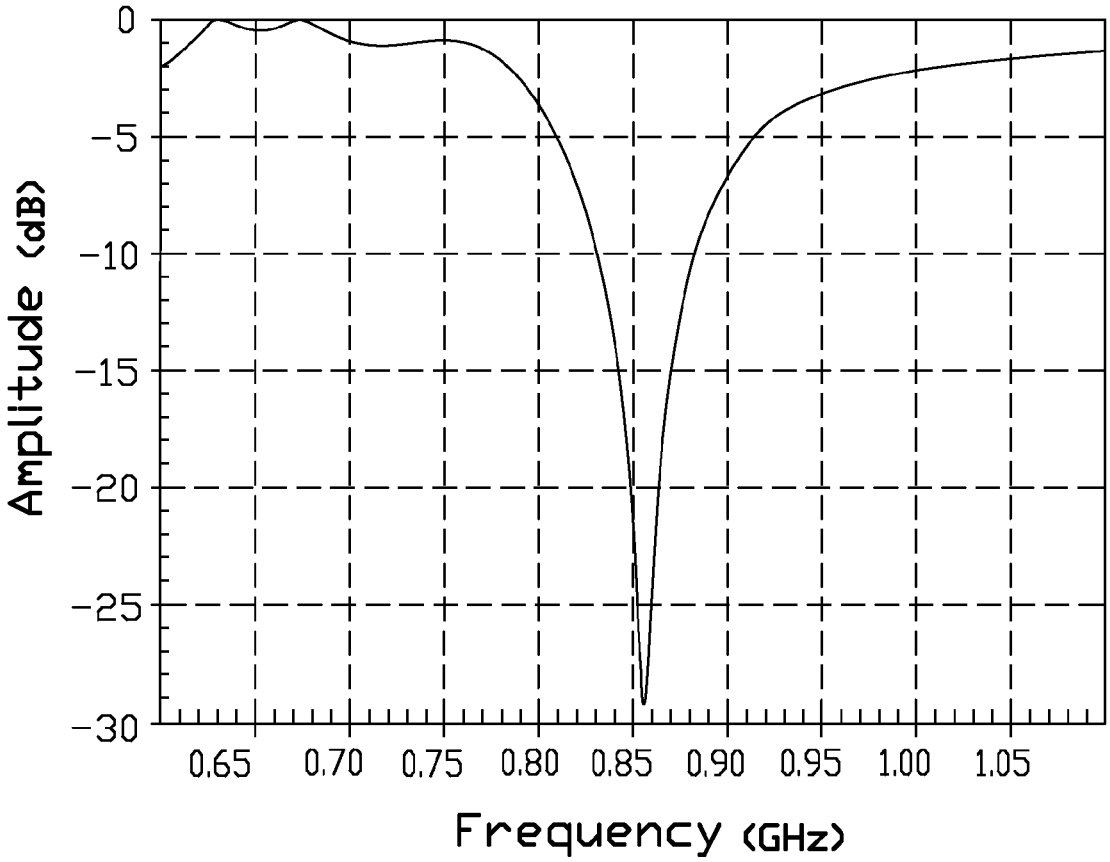
FIG. 4 is a graph of simulated test results showing reflection coefficients of the antenna of the wireless communication device of FIG. 1.

FIG. 4 is a graph of simulated test results showing reflection coefficients of the antenna 12 of the wireless communication device 10 of FIG. 1. As shown, when the antenna 12 operates at working frequency bands of 824~894 MHz, its reflection coefficient is less than −6 dB.

Figure 5:
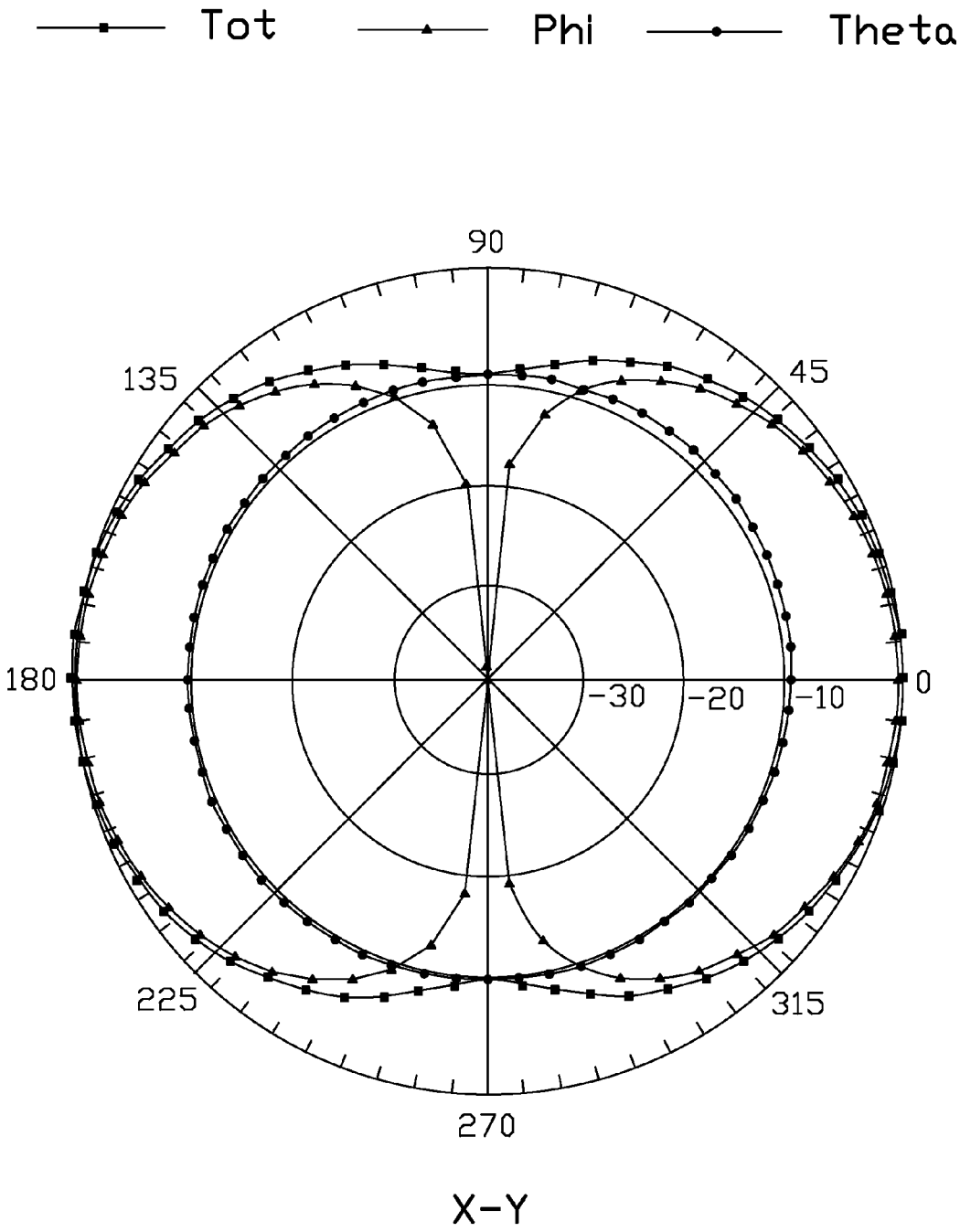
FIGS. 5-7 are graphs of simulated test results showing radiation patterns of the antenna of the wireless communication device of FIG. 1.
Figure 6:
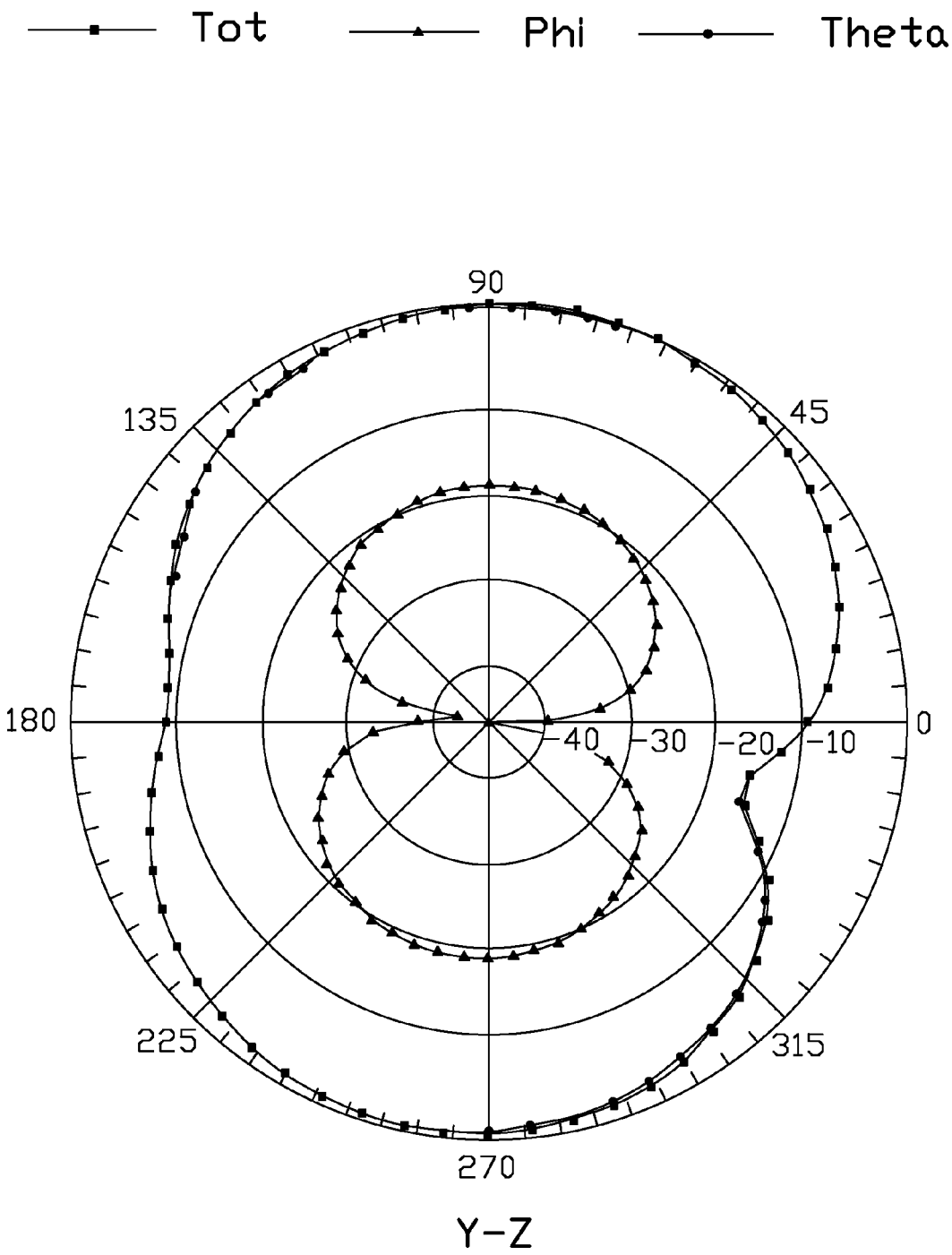
Figure 7:
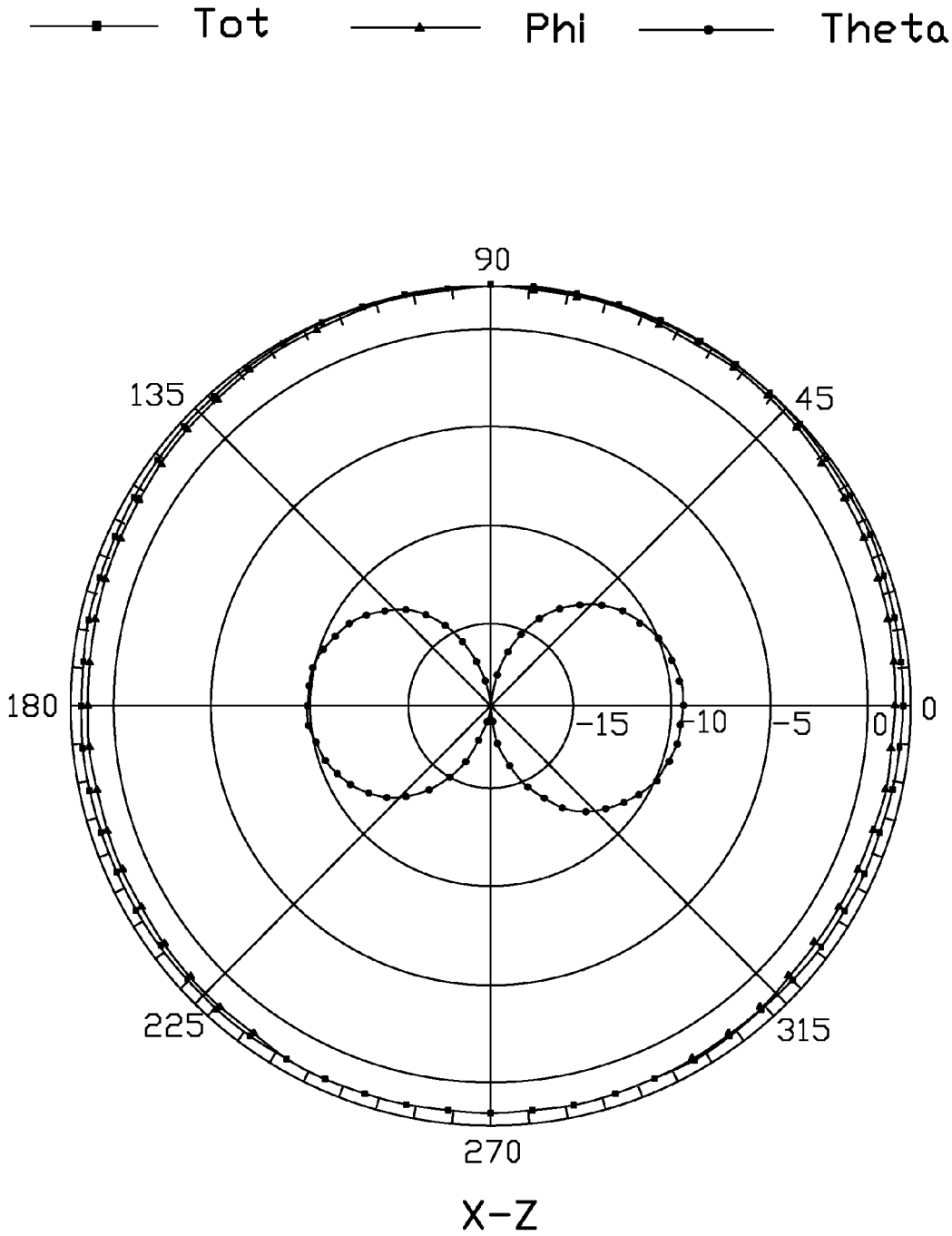
Figure 8:
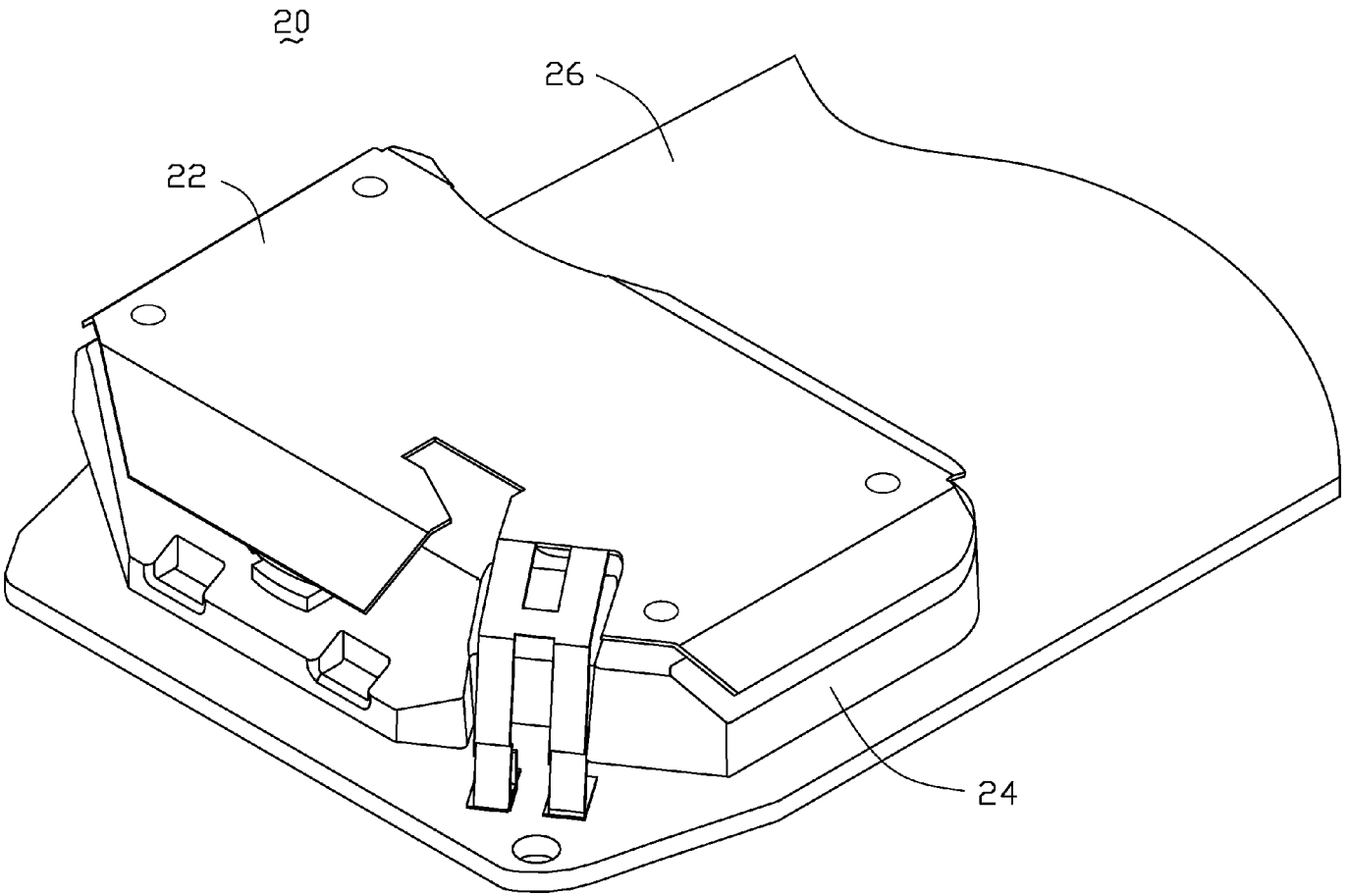
FIG. 8 (RELATED ART)
FIG. 8 is a schematic diagram of a conventional wireless communication device.

FIGS. 5-7 are graphs of simulated test results showing radiation patterns when the antenna 12 of the wireless communication device 10 of FIG. 1 is operated at 856 MHz. It is to be noted that for X-Z plane the radiation patterns are close to an optimal radiation pattern when the antenna 12 of the wireless communication device 10 of FIG. 1 is operated at 856 MHz.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A wireless communication device, comprising:

an electronic element;

an antenna, for radiating and receiving electromagnetic signals, disposed on one side of the electronic element;

a support member, comprising at least one support portion disposed between the antenna and the electronic element to form a space for spacing the antenna and the electronic element; and a circuit board disposed on an opposite side of the electronic element, and another support portion of the support member disposed between the electronic element and the circuit board to form another space for spacing the electronic element from the circuit board.

2. The wireless communication device of claim 1, wherein the electronic element is an acoustic module.

3. The wireless communication device of claim 1, wherein a height of the space between the antenna and the electronic element is in a range of 0.1~2.0 mm.

4. The wireless communication device of claim 1, wherein a height of the space between the electronic element and the circuit board is in a range of 0.1~2.0 mm.

5. The wireless communication device of claim 1, wherein the electronic element comprises a first surface and a second surface opposite to the first surface.

6. The wireless communication device of claim 1, wherein the support portion between the antenna and the electronic element is disposed on the first surface of the electronic element, and extends into the space formed between the antenna and the electronic element.

7. The wireless communication device of claim 6, wherein the support portion between the electronic element and the circuit board is disposed on the second surface of the electronic element, and extends into the space formed between the electronic element and the circuit board.

8. The wireless communication device of claim 1, wherein the support element further comprises a fixing portion connected to the support portion between the antenna and the electronic element, and the fixing portion is provided for fixing the antenna on the support portion between the antenna and the electronic element.

9. The wireless communication device of claim 8, wherein the fixing portion is plastic.

10. The wireless communication device of claim 9, wherein the fixing portion is at least one cylinder.

11. The wireless communication device of claim 9, wherein the antenna comprises at least one hole corresponding to the fixing portion, and the fixing portion is inserted into the hole.

12. The wireless communication device of claim 1, wherein the support member and the electronic element are formed integrally.

13. A wireless communication device, comprising:

a circuit board disposed in said wireless communication device an electronic element disposed beside said circuit board, and defining a first surface and a second surface opposite to said first surface for facing said circuit board an antenna defining a plane for radiating and receiving electromagnetic signals, said antenna disposed beside said electronic element opposite to said circuit board to face said first surface of said electronic element, a distance between said plane of said antenna and said circuit board being larger than a distance between said first surface of said electronic element and said second surface of said electronic element so as to form a separating space between said antenna and said first surface of said electronic element.; and another separating space formed between said second surface of said electronic element and said circuit board.

14. A wireless communication device, comprising:

an electronic element;

an antenna for radiating and receiving electromagnetic signals, and disposed at one side of the electronic element;

a support member abutting against the one side of the electronic element, and comprising at least one support portion directly engaging with the antenna and the electronic element respectively so as to be disposed between the antenna and the electronic element and form a space for spacing the antenna from the electronic element; and a circuit board disposed on an opposite side of the electronic element arid another support portion of the support member disposed between the electronic element and the circuit board to form another space for spacing the electronic element from the circuit board.

15. The wireless communication device of claim 14, wherein the support member and the electronic element are integrally formed together.

* * * * *